US005353487A

United States Patent [19]

Choh et al.

[11] Patent Number: 5,353,487

[45] Date of Patent: Oct. 11, 1994

[54] AUTOMATIC REEDING APPARATUS AND AUTOMATIC REEDING METHOD

[75] Inventors: Hitoshi Choh; Tomoyoshi Ikeda, both of Tokorozawa, Japan

[73] Assignee: Nippon Filcon Co., Ltd., Tokyo, Japan

[21] Appl. No.: 27,329

[22] Filed: Jan. 25, 1993

[30] Foreign Application Priority Data

Feb. 10, 1992 [JP] Japan ..... 4-067872

[51] Int. Cl.[5] ..... D03J 1/14; B65H 1/00

[52] U.S. Cl. ..... 28/204; 28/208

[58] Field of Search ..... 28/201, 202, 203.1, 28/204, 205, 206, 207, 208, 212, 213

[56] References Cited

U.S. PATENT DOCUMENTS 2,707,317 5/1955 Mackay ..... 28/204
2,807,861 10/1957 Wieneke ..... 28/204
3,444,601 5/1969 Wieneke ..... 28/204
4,894,893 1/1990 Okuda ..... 28/204
5,029,374 7/1991 Naveh ..... 28/204
5,253,404 10/1993 Weber et al. ..... 28/204

FOREIGN PATENT DOCUMENTS 1075850 4/1986 Japan ..... 28/204

*Primary Examiner*—Clifford D. Crowder
*Assistant Examiner*—Larry O. Worrell, Jr.
*Attorney, Agent, or Firm*—Beveridge, DeGrandi, Weilacher, & Young

[57] ABSTRACT

An automatic reeding apparatus and an automatic reeding method is disclosed which can handle yarns having various diameters required for any of reeds. Prior art problems are avoided by removably attaching a simple structural device to the frame of a reed of a loom. With the apparatus and the method as described herein, a reeding process can be carried out precisely and efficiently without damaging dents and without skipping over any the reed marks into which no yarn is threaded.

15 Claims, 11 Drawing Sheets

AUTOMATIC REEDING APPARATUS AND AUTOMATIC REEDING METHOD

BACKGROUND OF THE INVENTION

The present invention relates to an apparatus for a method of automatically threading a yarn into a reed of a loom.

In the past it has been conventional practice that all work in the weaving process has been carried out manually. In particular, the threading of a yarn into a reed, that is, the so-called reeding has had to be carried out such that a yarn drawer is manually inserted through every reed mark or space between each of adjacent dents of a reed, and the yarn is drawn. Such an operation is troublesome, and further, since a second person is inevitably required for hooking a yarn onto the yarn drawer the work has had to be carried out by a pair of employees. Therefore, the operation has required a long time and a large number of persons, thereby contributing one of the causes which greatly lower production efficiency.

Efforts have been made to mechanize the above-mentioned operations in order to enhance productivity. For example, Japanese Patent Kokai Patent No. 61-42017 discloses a method in which a gear meshed with dents is rotated in order to thread a yarn while it is moved a distance corresponding to one reed mark. However, this method is likely to damage dents and can hardly be applied to a fine reed. Further, the gear has to be replaced with another one each time when the reed is changed. Accordingly, this has led to a problem of unsatisfactory workability. Further, a method in which a yarn is blown by an air stream so as to be drawn into the reed has been proposed. Although this method can be applied to a small diameter yarn such as multifilament or staple with no problems, this method cannot be practically applied to the case of monofilament having, in particular, a large diameter since such monofilament are relatively hard so that a yarn cannot be smoothly blown. This raises a practical problem. Moreover, such a reeding machine requires removal of a reed and installation of an extremely complicated device during the installation of the loom, and accordingly, the preliminary preparations require a long time.

DETAILED DESCRIPTION OF EMBODIMENTS

Figure 1:
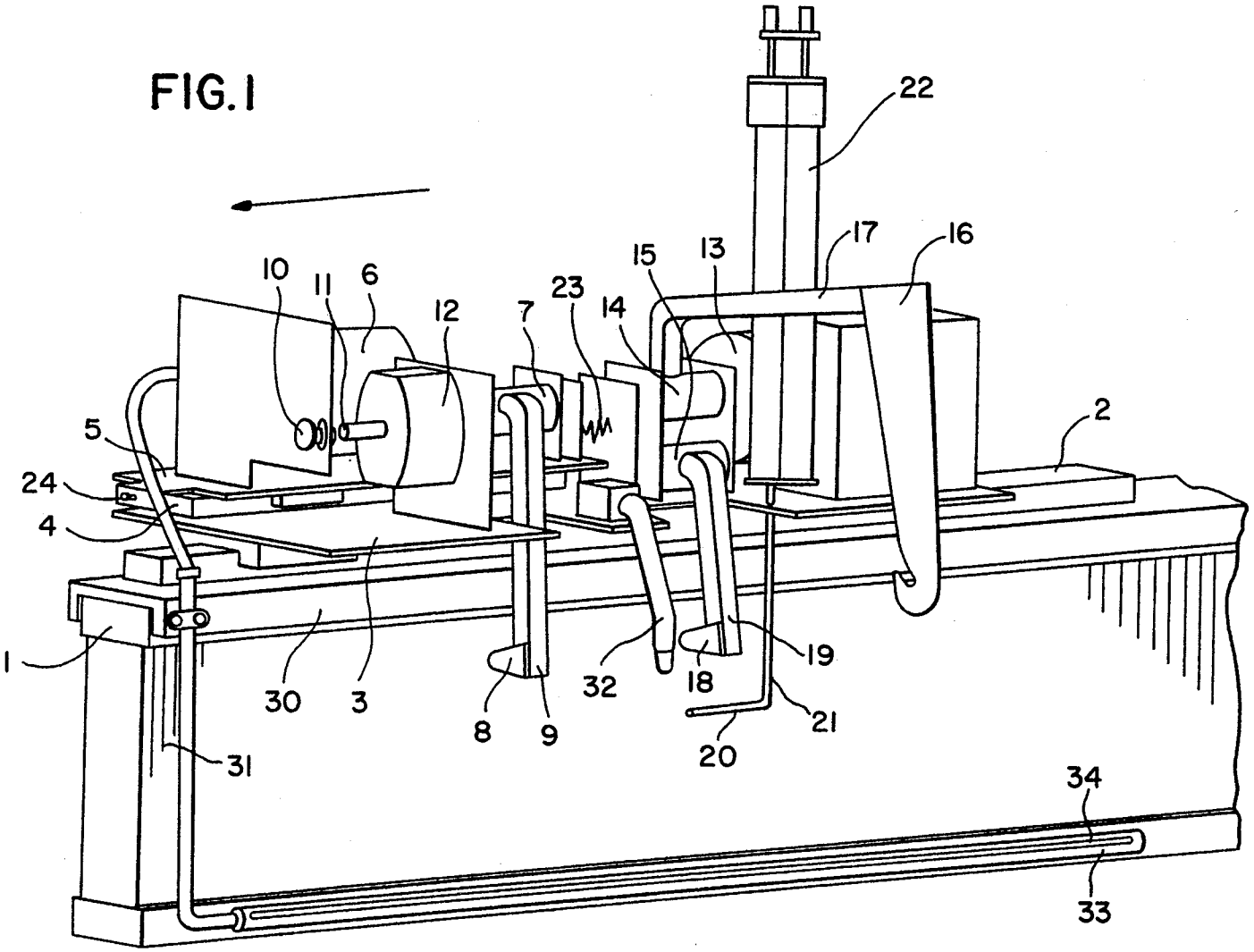
FIG. 1 is a perspective view illustrating an automatic feeding apparatus according to the present invention.

Explanation will be made of operation of an apparatus according to the present invention in order to facilitate the understanding of the effects of the present invention.

Referring to the drawings, the present invention relates to an automatic reeding apparatus including a main chassis running rail 2 located on the upper section of a reed upper frame 1. A main chassis 3 is silidably arranged on the running rail 2, and a subchassis running rail 4 is arranged on the chassis. A subchassis 5 is slidably arranged on the subchassis running rail. An air cylinder 6 is positioned on the subchassis 5. A heald feed arm is provided at its front end with a heald feed pawl 8 adapted to access reed spaces, and coupled to a shaft 7 rotatably connected to the air cylinder 6 so that the heald feed arm 9 is arcuately rotatable. A heald feed length adjusting device 10 is provided on the subchassis 5, with a heald feed air cylinder 12 provided with a shaft 11 adapted to abut against the heald feed length adjusting device 10 and mounted on the main chassis 3. An air cylinder 13 is provided to the main chassis 3 at a position at the rear of the air cylinder 12, with two shafts 14, 15 rotatably connected to the air cylinder 13. A threading arm 17 is provided at its front end with a threading pawl 16 and is coupled to the shaft 14 so that the threading arm 17 is arcuately rotatable. A heald feed arm 19 is provided at its front end with a heald feed pawl 18 adapted to access reed spaces and coupled to the shaft 15 so that the arm 19 is arcuately rotatable. Yarn sweep cylinder 22 is coupled thereto with a yarn sweep rod 21 having, at its one end, a bent yarn sweep part 20 and connected to said main chassis 3 so that the yarn sweep part 20 is located at a position where it crosses the threading arm 17 below the latter. An air jet pipe 32 is opened downward in the vicinity of a position where the yarn sweep part 20 sweep off a yarn and in connected to the main chassis 3. A vacuum suction device 33 extends substantially over the length of the bed 30 and is located below the yarn sweep part 20. A heald feed spring 23 is provided connecting the main chassis 3 and the subchassis 5 together, for urging the heald feed arm 19 side toward the heald feed arm 9.

In a more detailed aspect of the invention there is further provided to the subchassis running rail and the subchassis 5, an adjusting device for adjusting the space between the heald feed arm and the heald feed arm in accordance with a mesh of a reed upon start.

The heald feed length adjusting device is composed of the abutting part of the shaft, and an adjusting thread element formed of a male thread part coupled to the abutting part and a female thread part supporting the male thread part, so that the heald feed length is adjusted by means of the thread parts in accordance with a mesh of the reed.

Figure 3:
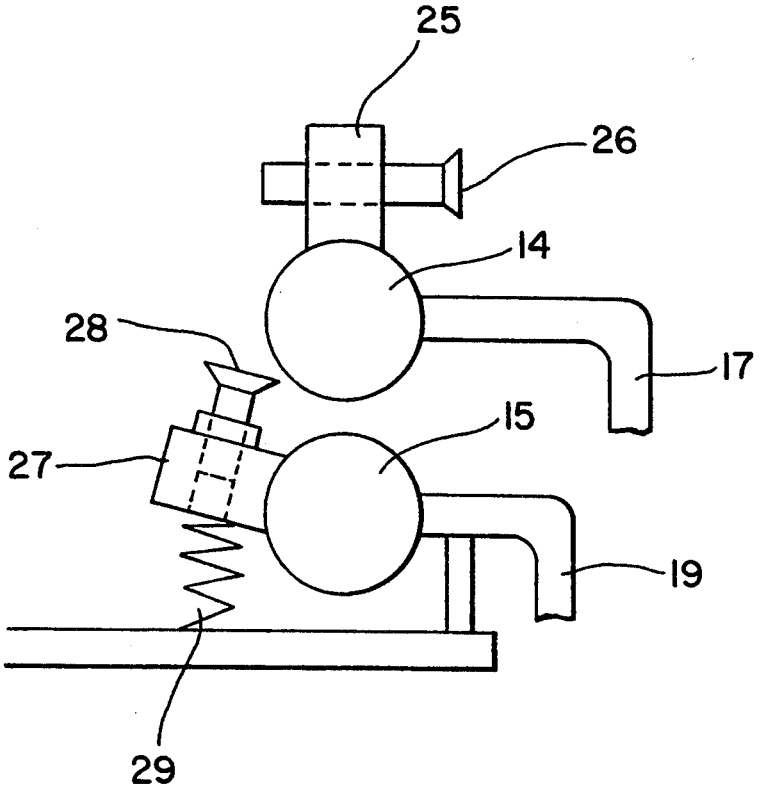
FIG. 3 is an explanatory view illustrating the threading arm interlocking mechanism in the automatic reeding apparatus.

In FIG. 3 there is shown to hammer 26 is provided to a protrusion which is provided to a protrusion 25 which is provided to the shaft 14 at a position counterclockwise from the coupling position of the threading arm 17 as viewed in front thereof. A hammer 28 is provided to a protrusion 27 which is provided at a position counterclockwise from the coupling position of the heald feed arm 19 as viewed in front thereof while a spring 29 for pushing the protrusion 27 upward so as to urge the shaft clockwise as viewed in front thereof is provided to the protrusion 27 whereby the shaft 15 is rotated in association with the rotation of the shaft 14.

The heald feed pawl and the heald feed arm serve for positioning upon start, and as a fulcrums for the subchassis upon heald feed. Also the heald feed pawl 8 and the heald feed arm 9 serve as fulcrums for the main chassis 3 upon heald feed.

The thickness of the heald feed pawl 18 is greater than that of the thread pawl 16 and are simultanrously inserted into a reed space.

In operation, the yarn sweep rod 21 removes a yarn drawn off by the threading arm 17 provided thereto with the threading pawl 16, from the pawl 16, and holds the same downward.

In carrying out the automatic reeding method with the use of an automatic reeding apparatus as described herein the followings step are followed:

(A) the threading pawl 16 and a heald feed pawl 18 are inserted into a reed space so that the threading pawl 16 grips a yarn while the heald feed pawl 18 secures a main chassis 3, (B) then an air cylinder 13 is opeated so as to rotate a shaft 14 counterclockwise, as viewed in front, causing the threading arm 17 to rotate upward in order to draw out the yarn and then thread the same into the reed, simultaneously the heald feed cylinder 12 is operated to cause the shaft 11 to push a heald feed length adjusting device 10 so as to move the subchassis 5, and subsequently, the air cylinder 6 is operated to insert the heald feed pawl 8 into the next reed space and to move the subchassis 5 by a distance corresponding to one reed space before the subchassis 5 is secured, and (C) then the threading arm 17 is raised up to a predetermined upper position so as to sufficiently draw out the yarn while operating the yarn sweep air cylinder 22 to move the yarn sweep rod 21 so as to sweep off the yarn from the threading pawl 16, the air from jet port (32) is jetted downward so as to depress the swept yarn which is therefore sucked by a vacuum suction device so that the yarn is held to the suction openings 34, meanwhile the heald feed pawl 8 is taken out from the reed space so as to release the main chassis 3 from its fixed condition, the operation of the heald feed air cylinder 12 is stopped so as to allow the urged heald feed spring 23 to move the main chassis 3, then the air cylinder 13 is operated to insert the heald feed pawl 18 into the next reed space while moving the main chassis 3 by a distance corresponding to one reed space, thereby fixing the main chassis 3, and finally the threading pawl is inserted thereinto.

The heald feed pawl 18 is inserted to a reed space so as to secure the main chassis 3. Further, the heald feed pawl 8 is inserted to a reed space so as to secure the subchassis 5. Since the main chassis 3 and the subchassis 5 are coupled together by the heald feed spring 23 urging the main chassis toward the subchassis, the main chassis is moved toward the subchassis when the heald feed pawl 18 is removed from the reed space so that the main chassis is released from its secured condition. Accordingly, when the removed heald feed pawl 18 is inserted to the next reed mark 18 so as to secure the main chassis 3, the main chassis 3 has been moved by a distance corresponding to one division or one reed space.

Thus, if each movement of the main chassis and the subchassis is limited to one division or one reed space, the yarn threader provided to the main chassis is moved by every reed space so as to thread a yarn into every reed space.

The above-mentioned operation is a basic operation for threading a yarn into a reed, according to the present invention. In order to execute the above-mentioned basic operation, a reeding apparatus according to the present invention, having a special arrangement is required.

Explanation will be made of the special arrangement according to the present invention and the operation thereof in the following paragraph describing an embodiment, with reference to the accompanying drawings.

FIG. 1 is a perspective view illustrating an automatic reeding apparatus according to the present invention. The arrow indicates the direction of the movement of the apparatus, that is, the head end of the arrow gives the forward direction.

A main chassis running rail 2 is positioned on a upper reed frame 1. In this embodiment, the main chassis running rail 2 is positioned on a bed 30 formed of U-like cross-sectional angle with which the upper reed frame 1 is covered. Any of other suitable methods can be also used for positioning the rail 2.

A main chassis 3 is slidably set on the running rail 2. In this embodiment, the main chassis 3 is located on a U-like cross-sectional shape angle with which the running rail 2 is covered. Any of other suitable methods can be also used for locating the main chassis 3. Reference numeral 31 denotes a dent.

A subchassis 5 is slidably set on a subchassis running rail 4 which is positioned on the main chassis 3.

Thus, the main chassis slides on the upper reed frame while the subchassis slides on the main chassis.

An air cylinder 6 which is provided on the subchassis 5 is adapted to arcuately rotate a heald feed arm 9 provided at its front end with a heald feed pawl 8 for accessing reed spaces, and accordingly, a shaft 7 coupled to the heald feed arm 9 is driven. The subchassis 5 is provided thereon with a heald feed length adjusting device 10 which is composed of, in this embodiment, a part abutting against a shaft 11 of a heald feed air cylinder 12, and a thread element comprising a male thread part coupled to the abutting part and a female part supporting the main part, and accordingly, the heald feed length can be adjusted in accordance with a mesh of a reed by the thread parts.

The heald feed air cylinder 12 which is provided thereto with the shaft 12 abutting against the above-mentioned heald feed length adjusting device 10 is positioned on the main chassis 3 so that the heald feed length adjusting device is pushed by the shaft 11 so as to move the subchassis 5. Further, an air cylinder 13 for arcuately rotating a threading arm 17 and a heald feed arm 19 is coupled to the main chassis 3 at a position in rear of the heald feed cylinder 12.

A shaft 14 is coupled thereto with the threading arm 17 provided at its front end with a threading pawl 16, and a shaft 15 is coupled thereto with a heald feed arm 19 provided at its front end with a heald feed pawl 18 so that the arms are arcuately rotated in association with rotation of these shafts. In this embodiment, these arms are rotated by about an angle of 90 degrees. However, they can be rotated by a suitable angle other than an angle of 90 degrees.

Further, a yarn sweep air cylinder 22 coupled thereto with a yarn sweep rod 21 having at its front end with a bent yarn sweep part 20 is provided on the main chassis 3 at a position where the yarn sweep part 20 extends crossing the threading arm 17 thereunder. The yarn sweep rod 21 is vertically moved downward to retain a yarn drawn by the threading pawl 16, and accordingly, the sweep of the yarn is completed.

Thus, the yarn passes through a reed space, but it largely tends to be returned to its previous position by being drawn back by its weight. In order to prevent the above-mentioned returning of a yarn, air is blown down onto the yarn swept off by the yarn sweep part so as to depress the yarn downward. Then, the yarn is sucked by a vacuum suction device 33 located below the yarn sweep part so as to hold the yarn by a suction hole 34. Thus, it is possible to prevent the yarn having passed through a reed space, from being returned to the previous position. A plurality of yarns in each of the groups held by the suction device are then tied up together, and accordingly, they never come off from the reed.

The length of the running rail 2 may be equal to that of the upper reed frame 1 in the loom, but may be set to a work unit length so that it is moved successively. In the case of successively moving the running rail, the bed 30 is moved along the frame 1 with the threading pawl 16 and the heald feed pawl 18 being inserted into a reed space after the running rail is terminated, and accordingly, the bed 30 can be successively moved without searching for the next reed space. The heald feed spring 23 couples the main chassis 3 with the subchassis 5 so as to urge the heald feed arm 19 side toward the heald feed arm 9. When the operation of the heald feed air cylinder 12 is stopped after the heald feed pawl 18 is pulled off from the reed space, the main chassis is moved toward the subchassis.

Figure 2:
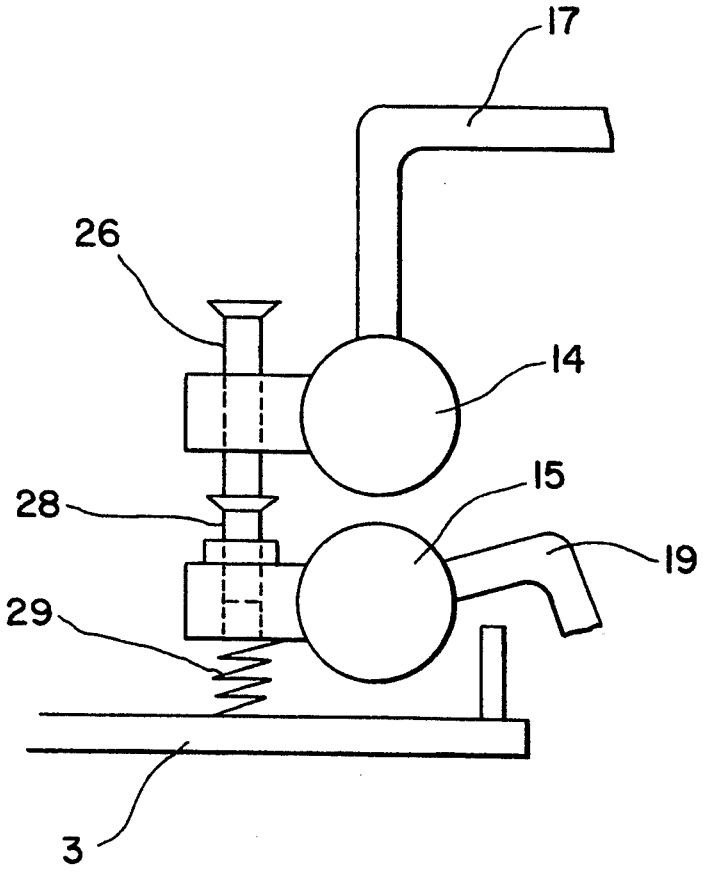
FIG. 2 is an explanatory view illustrating a threading arm interlocking mechanism in the automatic reeding apparatus.

FIG. 2 shows an interlocking mechanism for the threading arm 17 and the heald feed arm 19.

A protrusion 25 is provided to the shaft 14 at a position of an angle of 90 degrees counterclockwise from the coupling position of the threading arm 17 as viewed in front, and a hammer 26 is provided to the protrusion 25. A protrusion 27 is provided to the shaft 15 at a position counterclockwise from the coupling position of the heald feed arm 19 as viewed in front, and a hammer receiver 28 and a spring 29 for pressing the protrusion 27 upward so as to urge the shaft 15 counterclockwise, are provided to the protrusion 27. Referring to FIG. 2, when the threading arm 17 is rotated upward, hammer 26 abuts against the hammer 28 so as to push down the protrusion 27, overcoming the spring 29, and accordingly, the shaft 15 is rotated counterclockwise as viewed in front so that the heald feed arm 19 is moved upward.

FIG. 3 shows such a condition that the hammer 26 is separated away from the hammer receiver 28 since the shaft 14 is rotated clockwise as viewed in front, and accordingly, the shaft 15 is urged by the spring 29 so as to be rotated clockwise. Accordingly, the threading arm 17 and the heald feed arm 19 are associated with each other.

According to the present invention, these arms are operated with a predetermined time relation. However, the interlocking mechanism is not always essential for operating these arms, but these arms can be driven with a suitable timing by independent drive devices, respectively.

Figure 11:
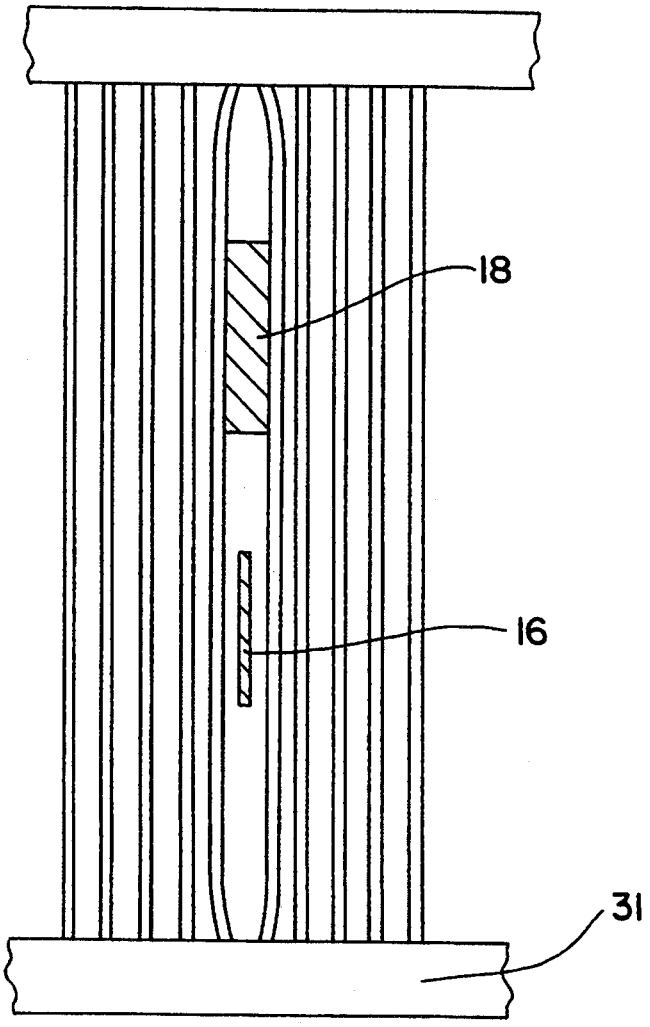
FIG. 11 is a sectional view illustrating thickness of a heald feed pawl and a threading pawl 16 which are inserted in a reed space.

FIG. 11 shows the condition when the heald feed pawl is inserted into a reed space which is opened widely and into which the threading arm 16 can be easily introduced. The thickness of the heald feed pawl 18 which is larger than that of the threading pawl 16 facilitates the introduction of the threading pawl 16, and accordingly, a yarn can be smoothly drawn without damaging dents 31.

The following is an explanation of the reeding method using the automatic feeding apparatus according to the present invention.

Figure 4:
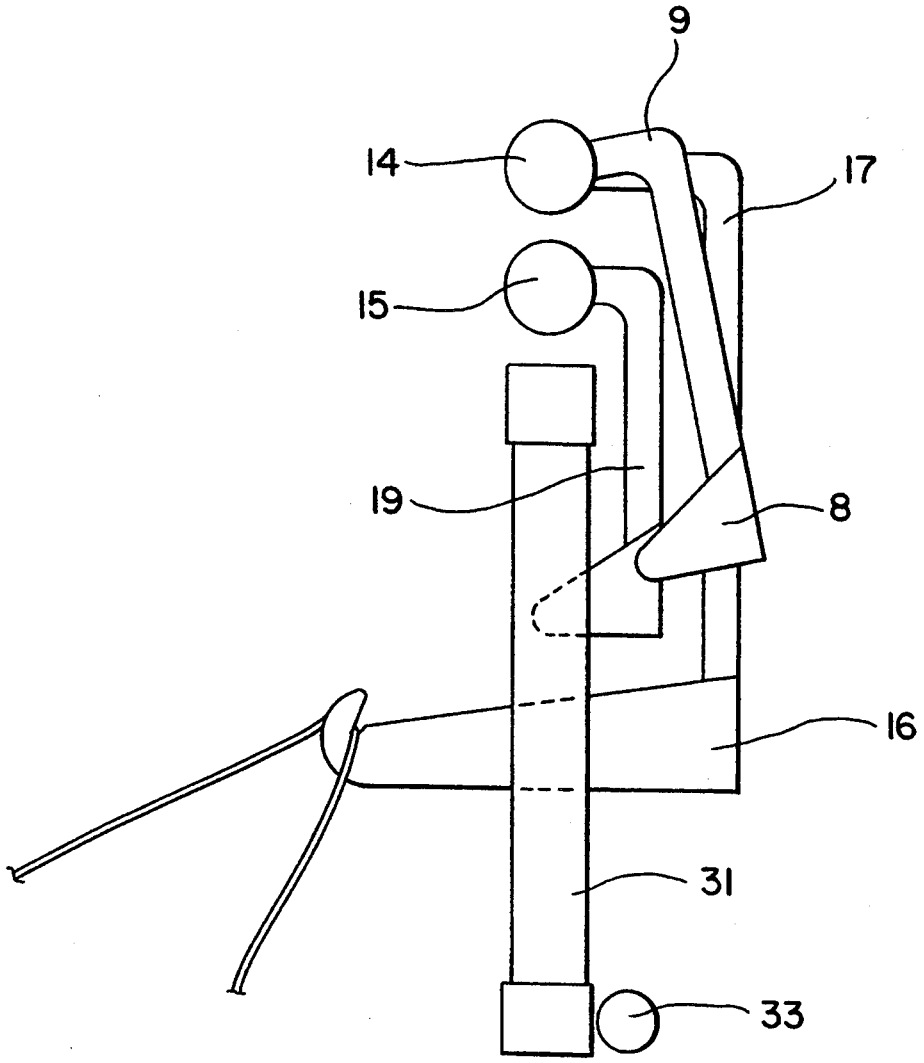
FIG. 4 is an explanatory view showing threading operation of the automatic reeding apparatus.

FIG. 4 shows a starting condition in which the threading pawl 16 and the heald feed pawl 18 are inserted in a reed space. A yarn is hooked on the threading arm 16 before the start, The main chassis 3 is fixed and is stationary.

The vacuum suction device 33 sucks up and holds the yarn.

Figure 5:
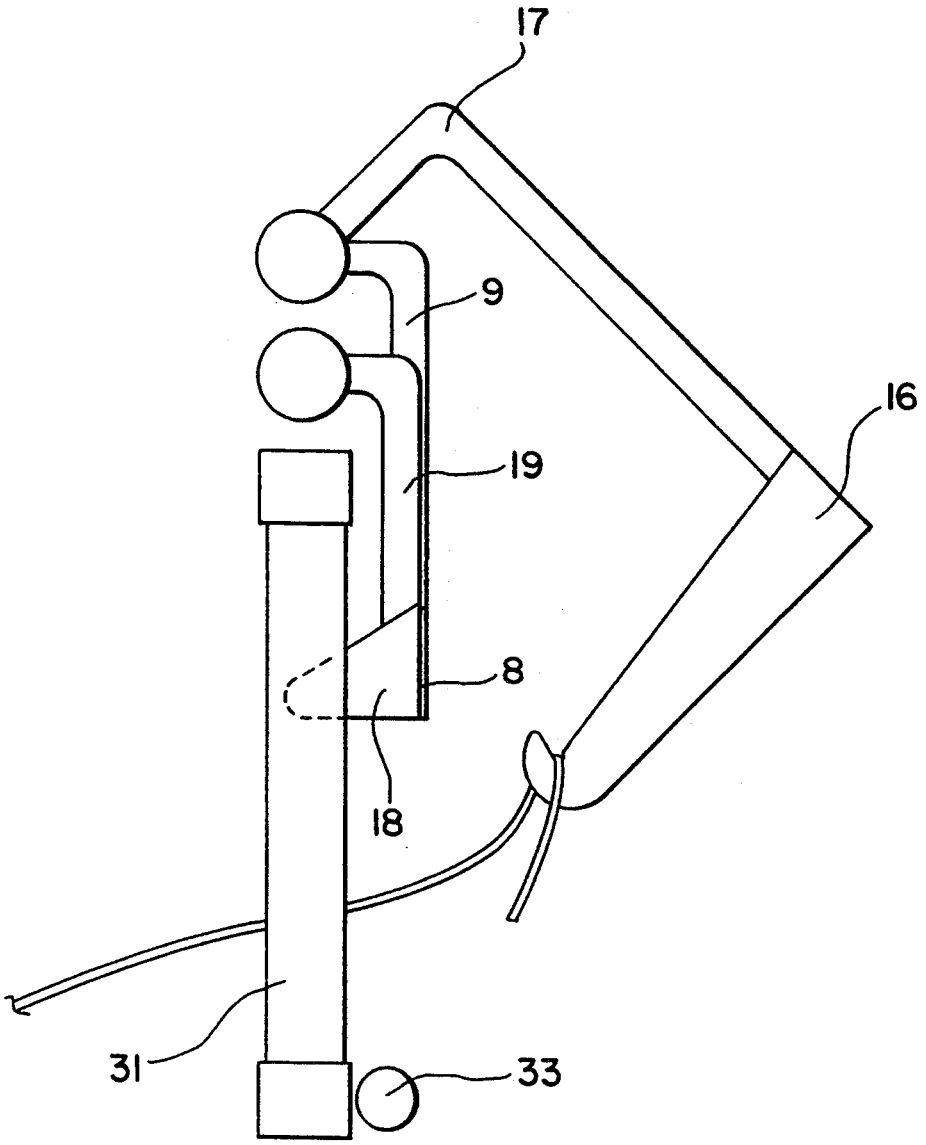
FIG. 5 is an explanatory view showing threading operation of the automatic reeding apparatus.

FIG. 5 shows the next step in the reeding method. The air cylinder 13 is operated to rotate the shaft 14 counterclockwise, and accordingly, the threading arm 17 is rotated upward so as to drawn out the yarn and then introduce the yarn into the reed. Meanwhile the heald feed air cylinder 12 is operated, and accordingly, the shaft 11 pushes the heald feed length adjusting device 10. Although the heald feed pawl 18 is inserted into the reed space so that the main chassis 3 is fixed stationary, the subchassis 5 is moved by a distance corresponding to one reed space in association with the operation of the air cylinder 12 before the heald feed pawl 8 is inserted into the reed space and is fixed. Meanwhile, the yarn is sucked and held by the vacuum suction device 33.

Figure 6:
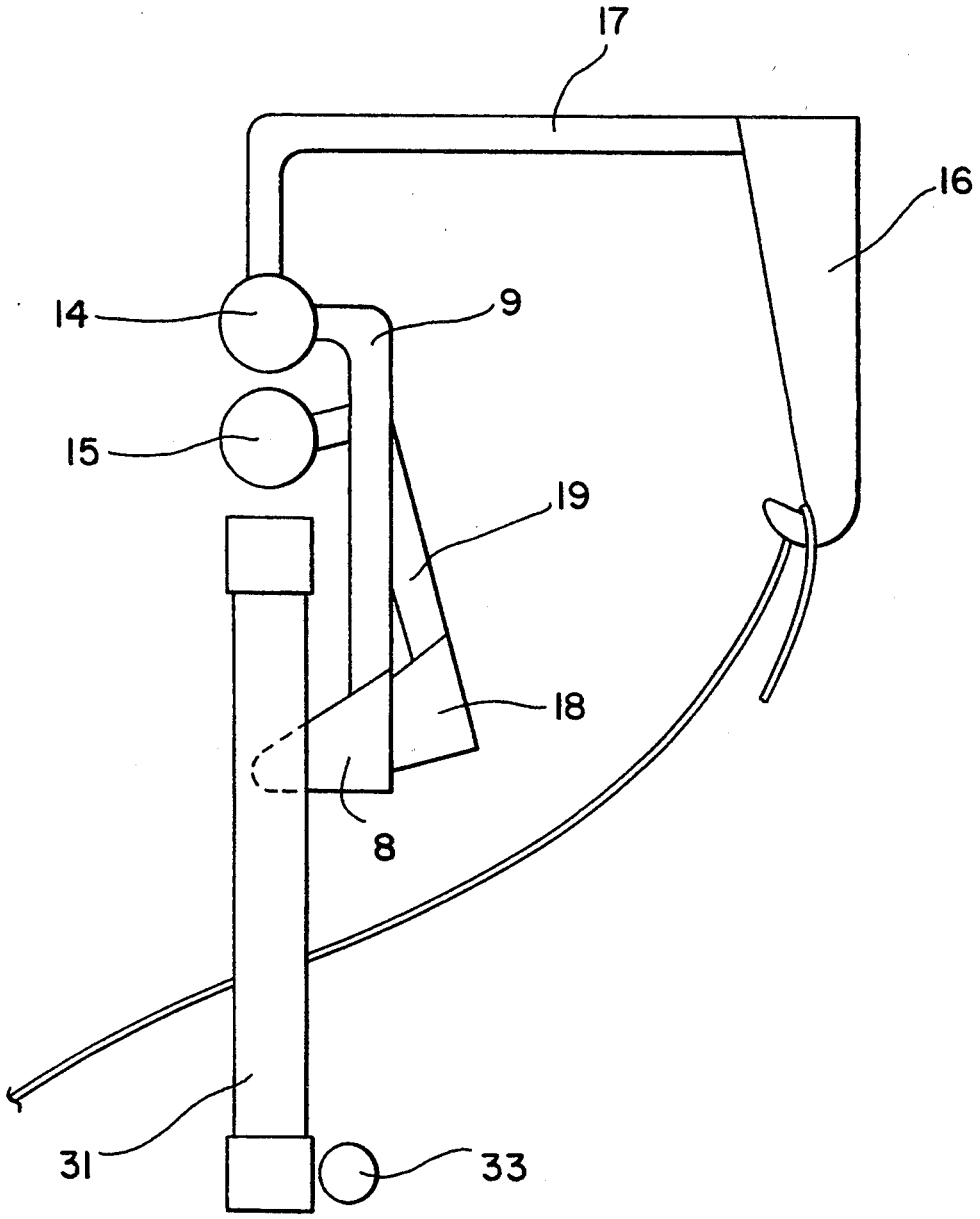
FIG. 6 is an explanatory view showing threading operation of the automatic reeding apparatus.

FIG. 6 illustrates the next step in the sequence. The threading arm 17 is raised up to a predetermined upper position. At this time, The yarn sweep air cylinder 22 is operated to move the yarn sweep rod 21, and accordingly, the yarn is swept downward from the threading pawl 16. Then, the heald feed pawl 18 comes out from the reed space so as to release the main chassis 3 from the fixed condition. When the heald feed air cylinder 12 comes to a stop, the subchassis 5 is not moved any further since the heald feed pawl 8 is inserted into a reed space and is secured while the main chassis 3 is moved by a distance corresponding to one reed space by being urged by the heald feed spring 23 before the heald feed pawl 18 is inserted and fixed in a reed space. Next, the threading pawl 16 is inserted into the heald feed pawl 18 while the vacuum suction device 33 sucks and holds the yarn. Thus, the procedure is returned into the condition shown in FIG. 4. The above-mentioned steps are repeated successively so as to carry out the drawing of the yarn.

Thus, with the use of the apparatus according to the present invention, each of the components can be operated with a predetermined timing, and accordingly, the drawing of a yarn can be readily and automatically carried out.

Explanation will be made specifically of the steps of drawing a yarn into the reed with reference to FIGS. 7 to 11, FIG. 7 is a starting condition in which the heald feed pawl 18 is inserted into a reed space so that the main chassis 3 is secured. The threading pawl 16 which has already been inserted in the reed space grips a yarn.

However, air is not yet jetted from the air jet pipe 32.

Figure 8:
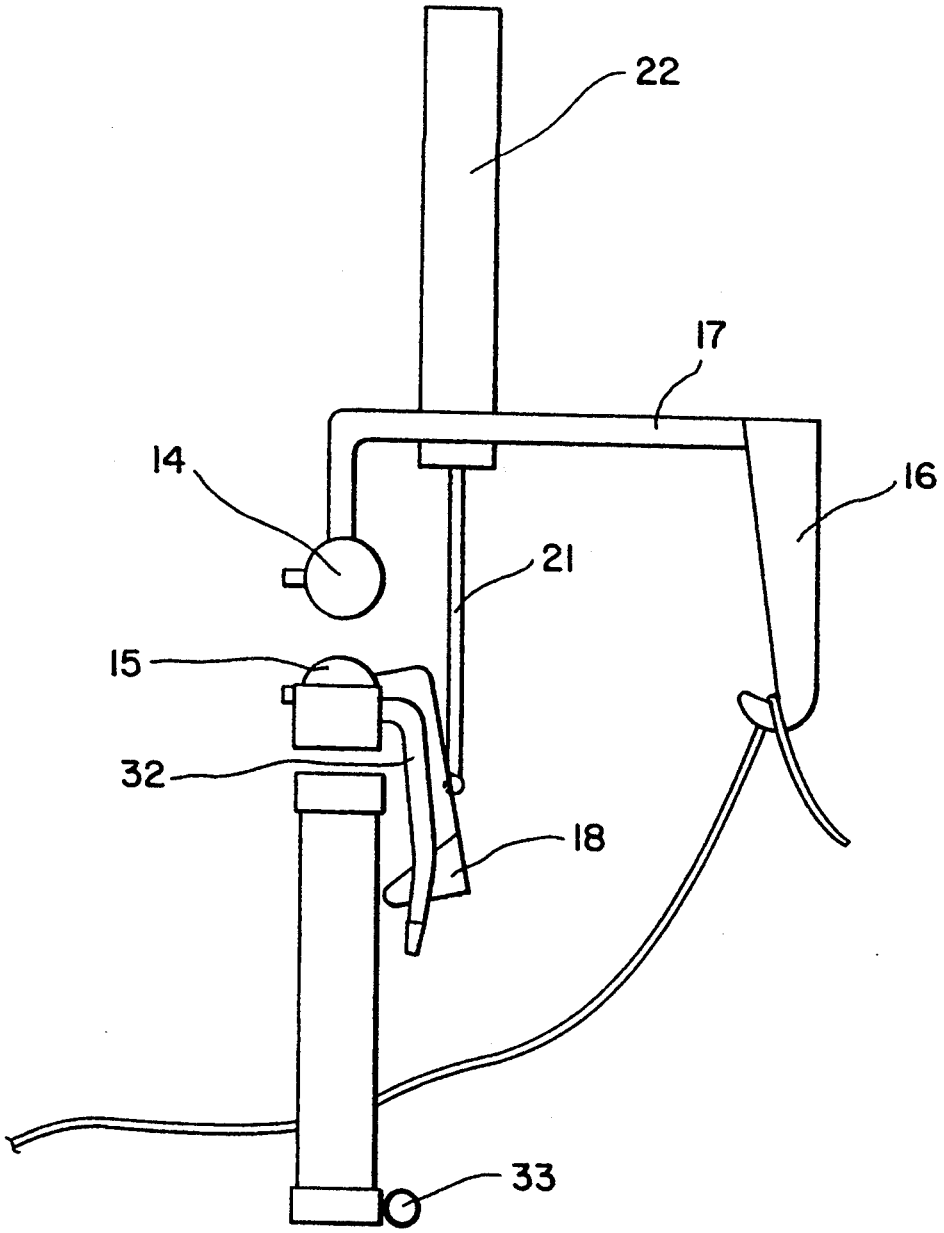
FIG. 8 is an explanatory view showing threading operation of automatic reeding apparatus.

Then, the respective components are moved to positions shown in FIG. 8. The shaft 14 then is rotated so that the threading arm 17 is raised to the predetermined upper position while the threading pawl 16 is pulled off from the reed space so that the yarn is drawn into the reed.

Thereafter, when the shaft 15 is rotated, the heald feed pawl 18 comes out from the reed space so that the main chassis 3 is released from its fixed condition. Air is not jetted from the air jet pipe 32.

Figure 9:
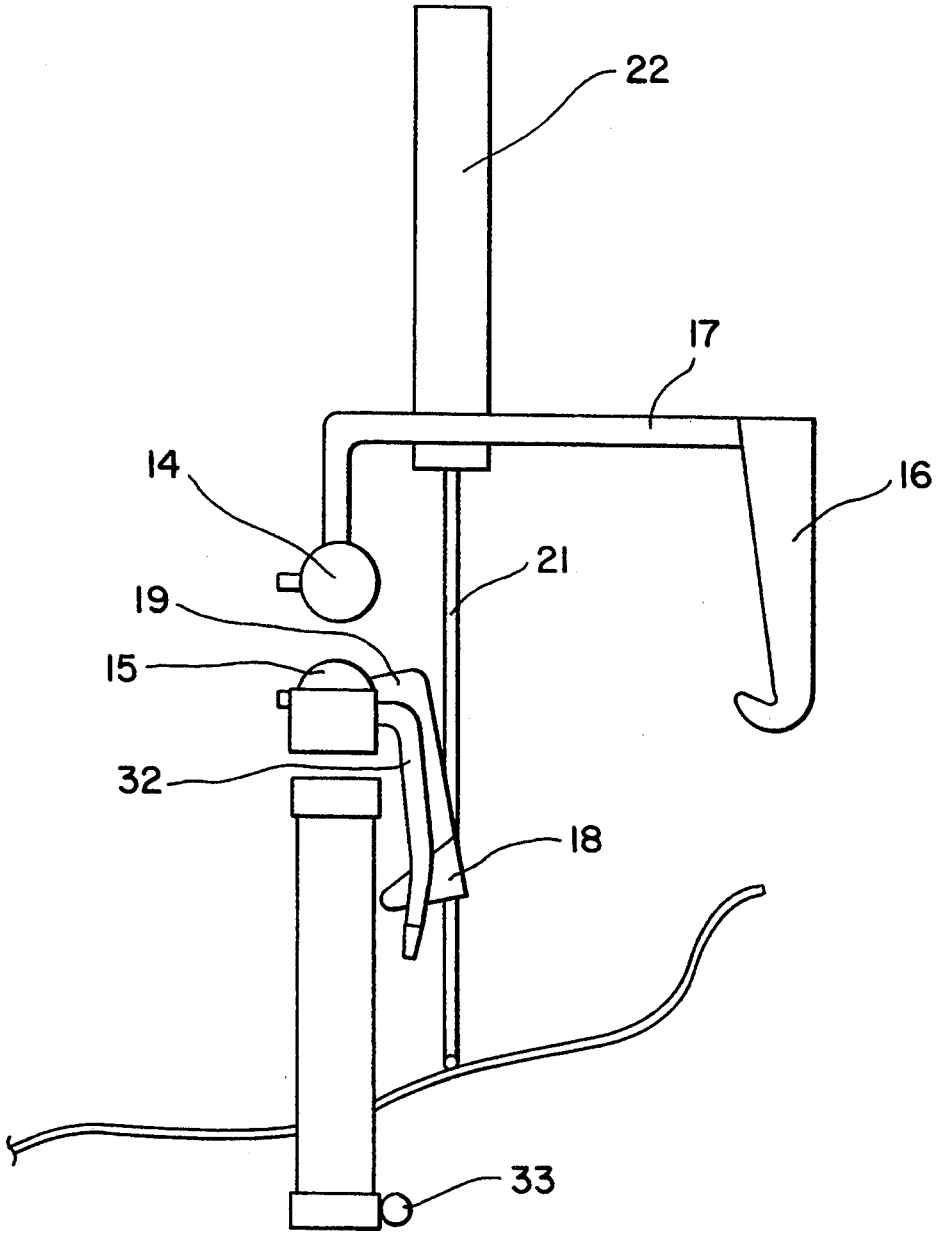
FIG. 9 is an explanatory view showing threading operation of the automatic reeding apparatus.
Figure 10:
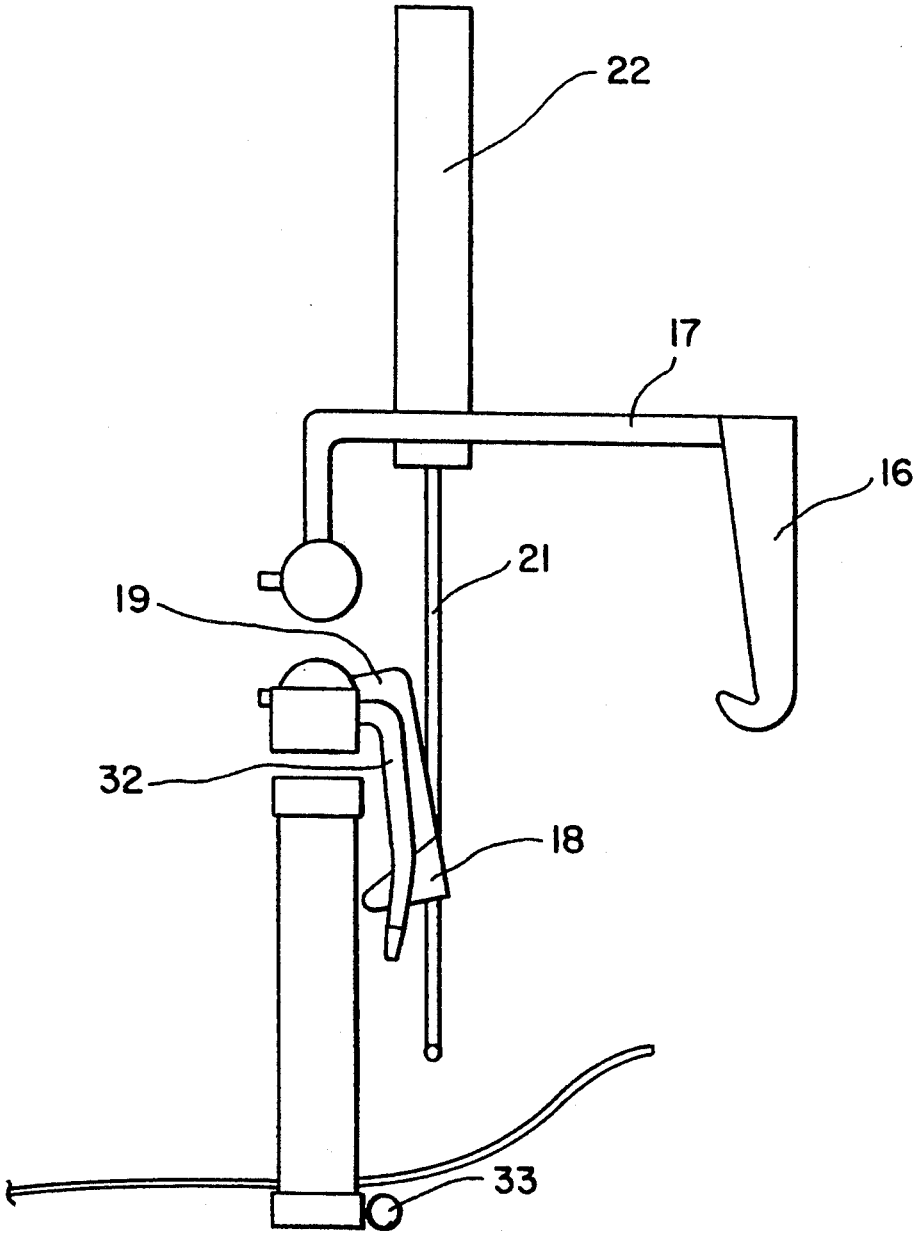
FIG. 10 is an explanatory view showing threading operation of the automatic reeding apparatus.

Next, the respective components are moved to positions shown in FIG. 9. Then, the yarn sweep cylinder 22 is operated to move the yarn sweep rod 21 so as to sweep the yarn down ward off the threading pawl 16. Air is jetted downward from the air jet pipe 32 so that the swept-down yarn is depressed downward, that is, toward the vacuum suction device. Then, the condition shown in FIG. 10 applies that is, the yarn is sucked and held by the vacuum suction device. Shafts 14, 15 then are rotated so that the heald feed pawl 18 is inserted into a reed space adjacent to the former reed space. Thus, the main chassis 3 is fixed, and then the threading pawl 16 is inserted into the reed space the same as inserted thereinto with the heald feed pawl 18.

Figure 7:
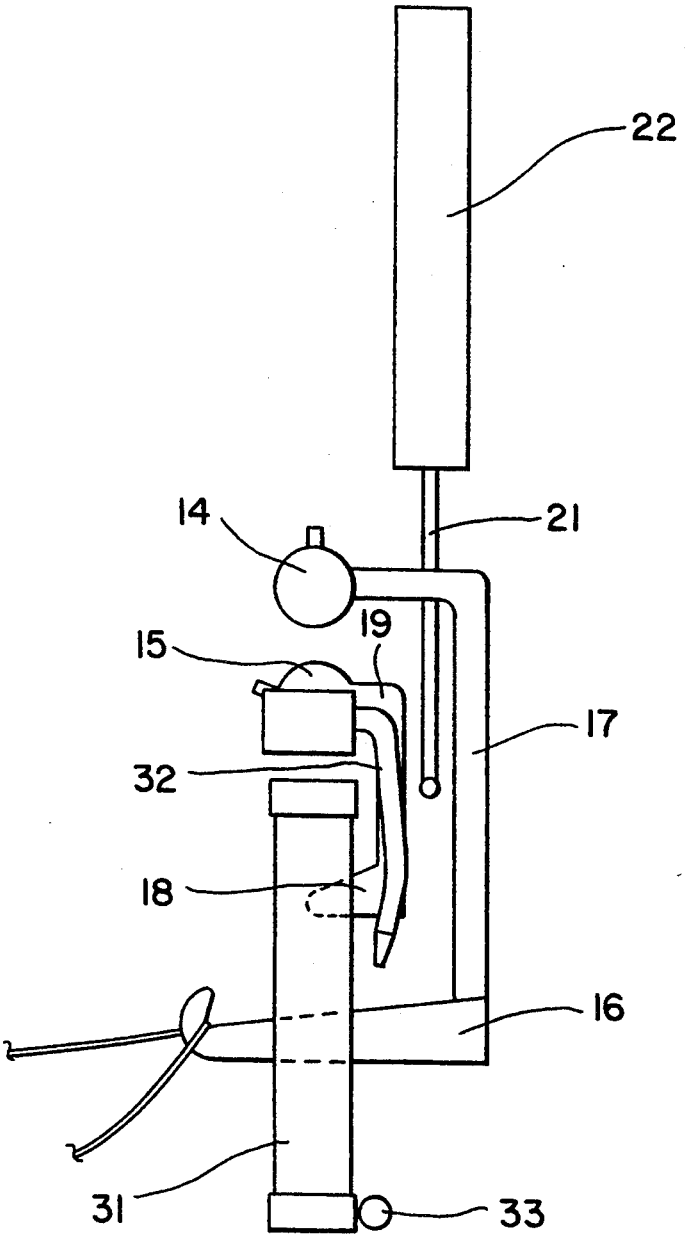
FIG. 7 is an explanatory view showing threading operation of the automatic reeding apparatus.

In this way, one cycle of the operation is completed, and the operation is then returned into a condition shown in FIG. 7. In view of the results obtained in practical use, it has been found that 1.2 to 1.5 sec/cycle is suitable.

Further, not only the reed space can be reversely followed but also the reeding can be reversely carried out by reversing the rotating direction. Further, a speed controller is preferably incorporated in an air cylinder or the like to as to adjust the cycle time.

Yarns having passed through the reed space are tied together in several groups in order to prevent the yarn from being returned.

As mentioned above, the present invention exhibits such an excellent technical effect that a yarn can be automatically introduced into a reed, rapidly and precisely without skipping over a reed space. According to the present invention, only one worker is needed to introduce yarn into a large number of reed space which is as large as about 2,500 per hour. In comparison, in conventional operations the number of reed space into which a pair of skilled workers can introduce yarns in one hour has been 2,000 at most. Accordingly, it is clear that the technical effects exhibited by the present invention are remarkable. Further, according to the present invention, yarns having passed through reed spaces can be prevented from being returned.

Further variation and modifications of the foregoing will be apparent to those skilled in the art and are intended to be encompassed by the claims appended hereto.

Japanese patent application No. 4-67872 the priority of which is claimed is relied on and incorporated herein by reference.

What is claimed is:

1. An automatic reeding apparatus comprising:

a reed frame, a main chassis running rail mounted on the upper section of the reed frame, a main chassis slidably mounted on the main chassis running rail, a subchassis running rail mounted on the main chassis, a subchassis slidably mounted on said subchassis running rail, a first air cylinder positioned on said subchassis, a first heald feed arm having first and second ends provided at the first end with a first heald feed pawl for inserting into reed spaces, and the second end being coupled to a first shaft rotatably connected to the first air cylinder so that the heald feed arm is arcuately rotatable, a heald feed length adjusting device provided on the subchassis, a heald feed air cylinder provided thereto with a second shaft abutting against the heald feed length adjusting device and mounted on the main chassis, a second air cylinder provided on the main chassis, wherein the main chassis further comprising: third and fourth shafts rotatably connected to the second air cylinder, a threading arm having third and fourth ends provided at the third end with a threading pawl and the fourth end being coupled to the third shaft so that the threading arm is arcuately rotatable, a second heald feed arm having fifth and sixth ends provided at the fifth end with a second heald feed pawl for inserting into reed spaces and the sixth end being coupled to the fourth shaft so that the second heald feed arm is arcuately rotatable, a yarn sweep cylinder with a yarn sweep rod having a bent yarn sweep part so that the bent yarn sweep part is positioned below the threading arm, and an air jet pipe for depressing the yarn having an opening for jetting air, wherein said apparatus further comprising a vacuum suction device extending substantially over the length of the reed frame and provided below the yarn sweep part, and a heald feed spring connecting the main chassis and the subchassis together, for urging the heald second feed arm toward the first heald feed arm.

2. An automatic reeding apparatus as claimed in claim 1, further comprising an adjusting device for adjusting the space between the first heald feed arm and the second heald feed arm in accordance with distance of the reed spaces, the adjusting device being positioned between the subchassis running rail and the subchassis.

3. An automatic reeding apparatus as set forth in claim 1, wherein the heald feed length adjusting device further comprising an abutting part against which the second shaft abuts, and an adjusting thread element comprising a male thread part coupled to the abutting part and a female thread part supporting the male thread part, so that the heald feed length is adjusted by means of the thread parts in accordance with distance of the reed spaces.

4. An automatic reeding apparatus as claimed in claim 1, further comprising a first protrusion connected to the third shaft, a first hammer connected to the first protrusion, a second protrusion connected to the fourth shaft, a second hammer to the second protrusion, and a spring inserted between the main chassis and the second protrusion for pushing the second protrusion upward wherein the fourth shaft is rotated in association with the rotation of the third shaft.

5. An automatic reeding apparatus as claimed in claim 1, wherein the second heald feed pawl and the second heald feed arm serve for positioning upon start, and as a support for the subchassis upon heald feed.

6. An automatic reeding apparatus as claimed in claim 1, wherein the first heald feed pawl and the first heald feed arm serve as a suport for the main chassis upon heald feed.

7. An automatic reeding apparatus as claimed in claim 1, wherein the thickness of the second heald feed pawl is greater than that of the threading pawl, and the second heald feed pawl and the threading pawl are simultaneously inserted into one and the same reed space at start.

8. An automatic reeding apparatus as claimed in claim 1, wherein the yarn sweep rod removes a yarn drawn off by the threading arm connected to the threading pawl, from the threading pawl, and holds the yarn downward.

9. An automatic reeding method comprising the steps of:

(a) providing an automatic reeding apparatus comprising:

a reed frame having a plurality of reed spaces;

a main chassis slidably positioned on the reed frame;

a subchassis slidably positioned on the main chassis;

a heald feed means connecting the main chassis and the subchassis and pushing the main chassis and the subchassis;

a vacuum suction device having a suction opening;

a heald feed spring connecting the main chassis and the subchassis;

the main chassis further comprising a threading pawl for hooking a yarn, a second heald feed pawl for inserting into reed spaces between the dents, the threading pawl being designed to hook a yarn during insertion of the second heald feed pawl into a reed space, a heald feed air cylinder having a second shaft; a yarn sweep air cylinder having a yarn sweep rod, an air jet port;

the subchassis further comprising a first heald feed pawl for inserting into the reed spaces and a heald feed length adjusting device;

(b) inserting the threading pawl and the second heald feed pawl into a reed space so that the threading pawl grips a yarn while the second heald feed pawl secures the main chassis, (c) rotating the threading pawl upward in order to draw out the yarn and then thread the yarn into the reed space, simultaneously operating the heald feed air cylinder to cause the second shaft to push the heald feed length adjusting device so as to move the subchassis, and subsequently, inserting the first heald feed pawl into another reed space whereby the subchassis is moved by a distance corresponding to one reed space and is secured in place, and (d) then raising the threading pawl up to a predetermined upper position so as to sufficiently draw out the yarn while operating the yarn sweep air cylinder to move the yarn sweep rod so as to sweep off the yarn from the threading pawl, jetting air downward from the air jet port so as to depress the swept yarn operating the vacuum suction device to hold the yarn in the suction opening, taking out the second heald feed pawl from the reed space so as to release the main chassis from its fixed condition, stopping the operation of the heald feed air cylinder, urging the heald feed spring to move the main chassis, then inserting the second heald feed pawl into the next reed space adjacent to the reed space whereto the second heald feed pawl was originally inserted, while moving the main chassis by a distance corresponding to one reed space, fixing the main chassis, and inserting the threading pawl into said space for gripping another yarn.

10. An automatic reeding apparatus comprising:

a reed frame having a plurality of dents and reed spaces;

a main chassis;

a main chassis running rail secured on the reed frame, the main chassis being slidably positioned on the main chassis running rail;

a subchassis;

a subchassis running rail secured on the main chassis, the subchassis being slidably positioned on the subchassis running rail;

a heald feed spring connecting the main chassis and the subchassis;

the subchassis further comprising a first air cylinder, a first shaft rotatably connected to the first air cylinder, a heald feed length adjusting device, and a first heald feed pawl for inserting into reed spaces between the dents, the first heald feed pawl being coupled to the first shaft whereby the first heald feed pawl being rotatable about the first shaft;

the main chassis further comprising a heald feed air cylinder, a second shaft connected to the heald feed air cylinder, the second shaft abutting against the heald feed length adjusting device, a second air cylinder, a third and a fourth shaft each of which being rotatably connected to the second air cylinder, a threading pawl for hooking a yarn coupled to the third shaft whereby the threading pawl is arcuately rotatable about the third shaft, a second heald feed pawl for inserting into reed spaces between the dents, the second heald feed pawl being coupled to the fourth shaft whereby the second heald feed pawl is arcuately rotatable about the fourth shaft;

wherein, the threading pawl is inserted into a reed space during insertion of the second heald feed pawl into the reed space so as to hook a yarn and draw the yarn through the reed, the first threading pawl is inserted into a reed space after the second shaft pushes the heald feed length adjusting device so as to move the subchassis during insertion of the second heald feed pawl into the reed space, then the second heald feed pawl is released from the reed space and the main chassis is moved by means of the heald feed spring.

11. An automatic reeding apparatus as set forth in claim 10, wherein the main chassis further comprising a yarn sweep rod which pushes the yarn after the yarn is hooked out through the reed space by the threading pawl.

12. An automatic reeding apparatus comprising:

a reed frame having a plurality of reed spaces;

a main chassis slidably positioned on the reed frame;

a subchassis slidably positioned on the main chassis;

a heald feed means connecting the main chassis and the subchassis;

the subchassis further comprising a first pawl for inserting into the reed spaces;

the main chassis further comprising a threading pawl for hooking a yarn, a second pawl for inserting into the reed spaces, the threading pawl being designed to hook a yarn during insertion of the second pawl into a reed space;

wherein, the first pawl is inserted into a reed space after the subchassis is moved by the heald feed means during insertion of the second pawl into a reed space, and the second pawl is released after the first pawl is inserted into the reed space and the yarn is hooked out through the reed by the threading pawl, and the main chassis is being pushed by the heald feed means.

13. An automatic reeding apparatus as set forth in claim 12, wherein the heald feed means comprises a spring connecting the main chassis and the subchassis, a heald feed length adjusting device provided on the subchassis and a heald feed shaft provided on the main chassis, wherein the spring urges the main chassis and the subchassis and the shaft pushes the heald feed length adjusting device, whereby the main chassis and the subchassis move relatively to each other.

14. An automatic reeding method comprising the steps of:

(a) providing an automatic reeding apparatus comprising:

a reed frame having a plurality of reed spaces;

a main chassis slidably positioned on the reed frame;

a subchassis slidably positioned on the main chassis;

a heald feed means connecting the main chassis and the subchassis and pushing the main chassis and the subchassis;

the subchassis further comprising a first heald feed pawl for inserting into the reed spaces;

the main chassis further comprising a threading pawl for hooking a yarn, a second heald feed pawl for inserting into the reed spaces, the threading pawl being designed to hook a yarn during insertion of the second heald feed pawl into a reed space;

(b) inserting the threading pawl and the second heald feed pawl into a reed space so as to have threading pawl grip a yarn while the second heald feed pawl secures the main chassis;

(c) returning the threading pawl to draw out the yarn through the reed space;

(d) pushing the subchassis by the heald feed means;

(e) inserting the first heald feed pawl into another reed space so as to secure the subchassis;

(f) raising the second heald feed pawl; and (g) pushing the main chassis by the heald feed means.

15. An automatic reeding method as set forth in claim 14, further comprising;

(h) inserting the second heald feed pawl into a reed space adjacent to the reed space whereto the second heald feed pawl being originally inserted, after the main chassis is pushed by the heald feed means.

* * * * *